US006179226B1

(12) United States Patent
Jen

(10) Patent No.: US 6,179,226 B1
(45) Date of Patent: Jan. 30, 2001

(54) HIGH PRESSURE CLEANING DEVICE HAVING SUDS CLEANING EFFICACY

(76) Inventor: Huang Y Jen, P.O. Box 82-144, Taipei (TW)

( * ) Notice: Under 35 U.S.C. 154(b), the term of this patent shall be extended for 0 days.

(21) Appl. No.: 09/484,435

(22) Filed: Jan. 18, 2000

(51) Int. Cl.[7] ..... B05B 7/26

(52) U.S. Cl. ..... 239/310; 239/63; 239/311; 239/318; 239/570; 137/505.35; 137/895

(58) Field of Search ..... 239/63, 310, 311, 239/318, 570; 137/505.29, 505.35, 888, 889, 895

(56) References Cited

U.S. PATENT DOCUMENTS

| | | | | |
|---|---|---|---|---|
| 129,015 | * | 7/1872 | Fay et al. | 137/505.35 |
| 414,975 | * | 11/1889 | Foster | 137/505.35 |
| 3,561,680 | * | 2/1971 | Ott | 239/570 X |
| 3,853,784 | * | 12/1974 | Rogers | 239/311 X |
| 5,626,291 | * | 5/1997 | Flinn et al. | 239/310 |

* cited by examiner

*Primary Examiner*—Andres Kashnikow
*Assistant Examiner*—Robin O. Evans

(74) *Attorney, Agent, or Firm*—A & J

(57) ABSTRACT

The present invention relates to a high pressure cleaning device having suds cleaning efficacy comprising a control body, containing a Venturi tube seat at the interior thereof, connected to the output of a pump, one side of the body being an inlet for the feeding of detergent and the other side being connected to a high pressurized air output pipe such that the water stream and the detergent are mixed and formed into suds flowing out from an water outlet of the body to the outside for cleaning purpose, characterized in that a bending opening is provided to the middle section of the of the body connected to the inlet and outlet water passage, and the opening edge of the bending opening, corresponding to the lateral side of the body, a pressure-adjusting device is provided and a plug shaft is inserted at the bending opening and in combination with the conic shape end of the shaft body and a press board mounted at the bottom end of the plug shaft to resist the pressure change of the pressure within the interior of the body, such that the press board is slidably moved within the air chamber of the body, the board moved to one lateral side will simultaneously pull the plug shaft to close the opening edge of the bending opening, thereby the water inlet or outlet is automatically closed at an appropriate time so as to ensure the stability of pressure within the body.

4 Claims, 3 Drawing Sheets

HIGH PRESSURE CLEANING DEVICE HAVING SUDS CLEANING EFFICACY

BACKGROUND OF THE INVENTION a) Technical Field of the Invention

The present invention relates to a high pressure cleaning device with suds cleaning efficacy, and in particular, a cleaning device having a body provided with a bending water passage and with a pressure balancing design so as to stabilize the pressure at the interior of the body.

b) Description of the Prior Art

FIGS. 5 and 6 show a conventional cleaning device with a control body comprising two connection pipes 31 in combination with a Venturi tube seat 32 forming into a control body 30. One end of the body 30 is an inlet for water stream, and the other end is a water outlet connection for the output of cleaning water stream after mixing. The entire mixing of detergent is that the increasing pressure of the Venturi tube seat 32 to suck out the detergent together with the water stream from the pump, after that, via the storage tank 33 to reduce the speed of flow so that sufficient mixing with water is achieved. The mixed fluid passes to the pipe connector 34, connected to high pressurized air, located at one side of the storage tank 33 so as to produce suds for cleaning requirements. There is no control device to assist the opening and closing of the cleaning operation, and for a safety precaution, a low pressure pump of below 40 kg/cm is used. However, if the water outlet is closed or interrupted, water recycling will cause a pressure increase at the interior of the body 30. Thus, there are problems such as the safety of the output pipe, and the water will reverse flow to the detergent or the air pipe, which causes the detergent to deform or to block the air pipe. As a result, in operation, the pump can only be used at a low pressure and the procedures of pump operation have to be in standard sequences. That is, the output of the pump has to be closed first, then the opening at the end of the cleaning pipe is closed. This causes a waste of water stream, detergent and the high pressurized air so as to maintain the safe utilization of pipes.

Thus, it is a main object of the present invention to mitigate the drawbacks of the conventional design.

SUMMARY OF THE INVENTION

Accordingly, it is an object of the present invention to provide a high pressure cleaning device, wherein the middle section of the control body of the device is provided with a plug shaft to adjust pressure such that when the recycle pressure is too high, the water inlet pipe is simultaneously closed to prevent the excessive pressure, which is unsafe in operation.

Yet another object of the present invention to provide a high pressure cleaning device, wherein the cleaning operation is convenient and safe.

One aspect of the present invention is to provide a high pressure cleaning device having suds cleaning efficacy comprising a control body, containing a Venturi tube seat at the interior thereof, connected to the output of a pump, one side of the body being an inlet for the feeding of detergent and the other side being connected to a high pressurized air output pipe such that the water stream and the detergent are mixed and formed into suds flowing out from an water outlet of the body to the outside for cleaning purpose, characterized in that a bending opening is provided to the middle section of the of the body connected to the inlet and outlet water passage, and the opening edge of the bending opening, corresponding to the lateral side of the body, a pressure-adjusting device is provided and a plug shaft is inserted at the bending opening and in combination with the conic shape end of the shaft body and a press board mounted at the bottom end of the plug shaft to resist the pressure change of the pressure within the interior of the body, such that the press board is slidably moved within the air chamber of the body, the board moved to one lateral side will simultaneously pull the plug shaft to close the opening edge of the bending opening, thereby the water inlet or outlet is automatically closed at an appropriate time so as to ensure the stability of pressure within the body.

Other objects, features and advantages of the invention will be apparent from the following description when read with reference to the accompanying drawings.

DETAILED DESCRIPTION OF THE PRESENT INVENTION

Figures 1, 2:
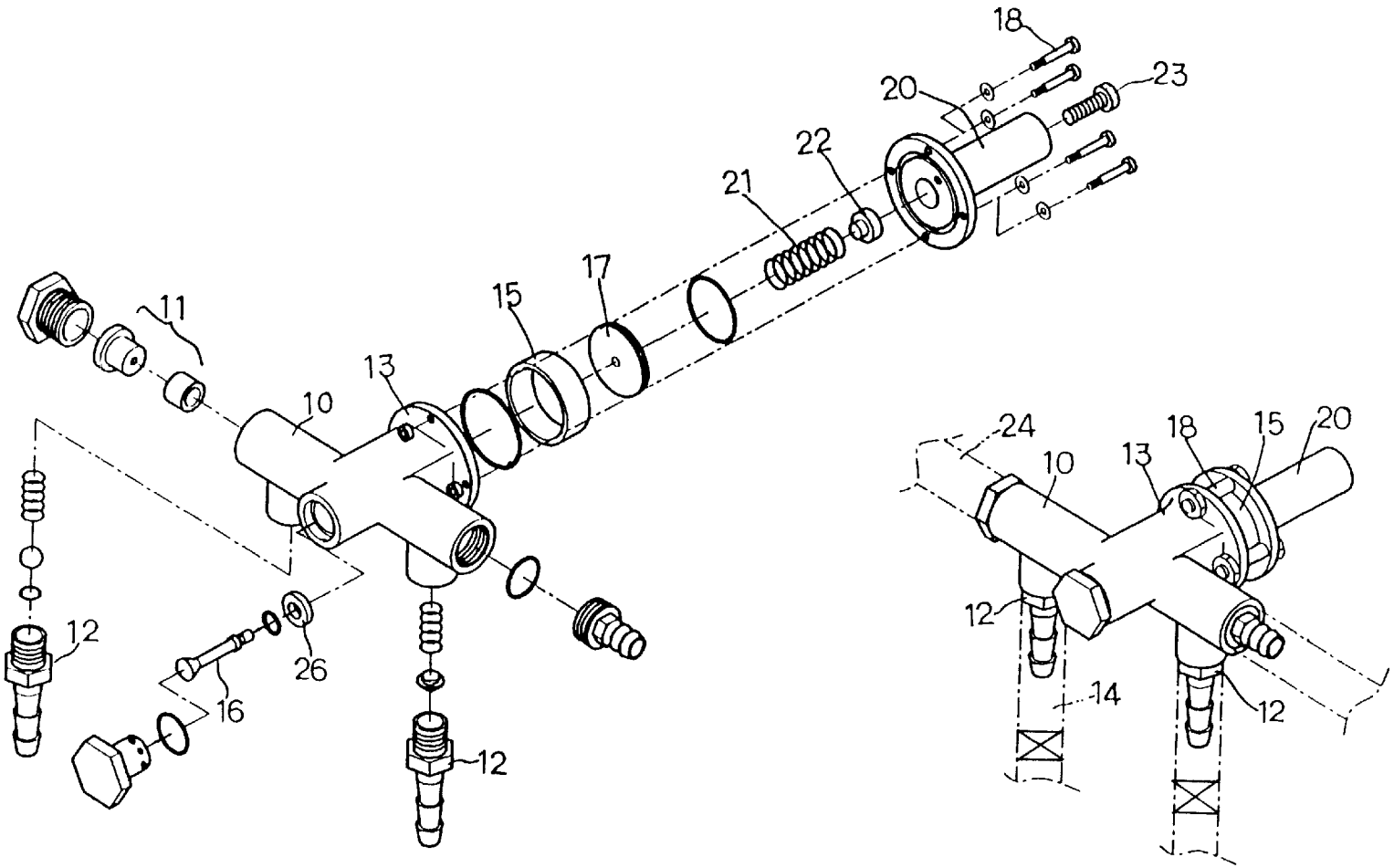
FIG. 1 is an exploded perspective view of the cleaning control body of the present invention.
FIG. 2 is a perspective view showing the implementation of the control body of the present invention.
Figure 3:
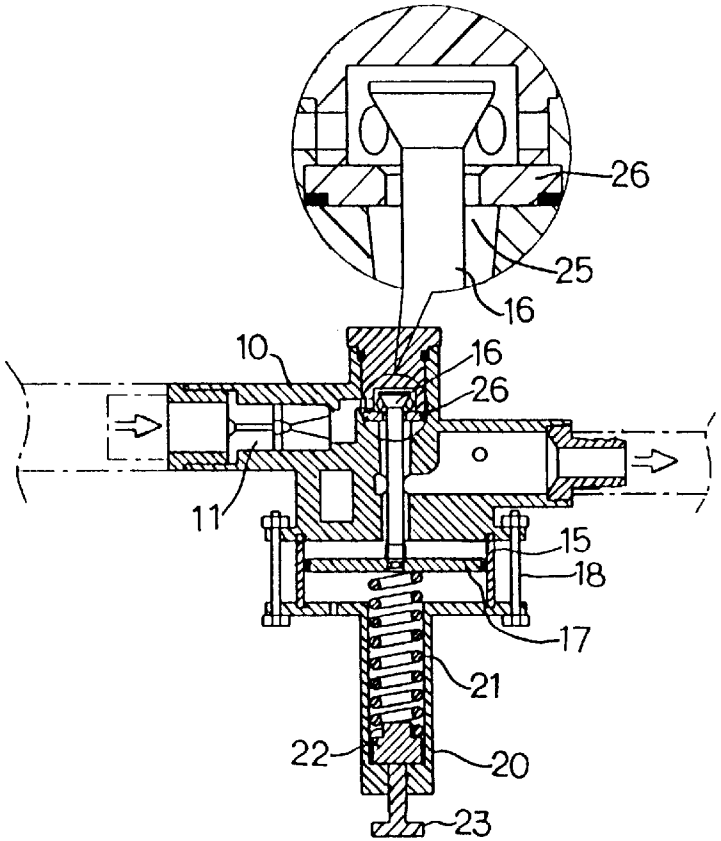
FIG. 3 is a sectional view of the control body of the present invention.
Figure 4:
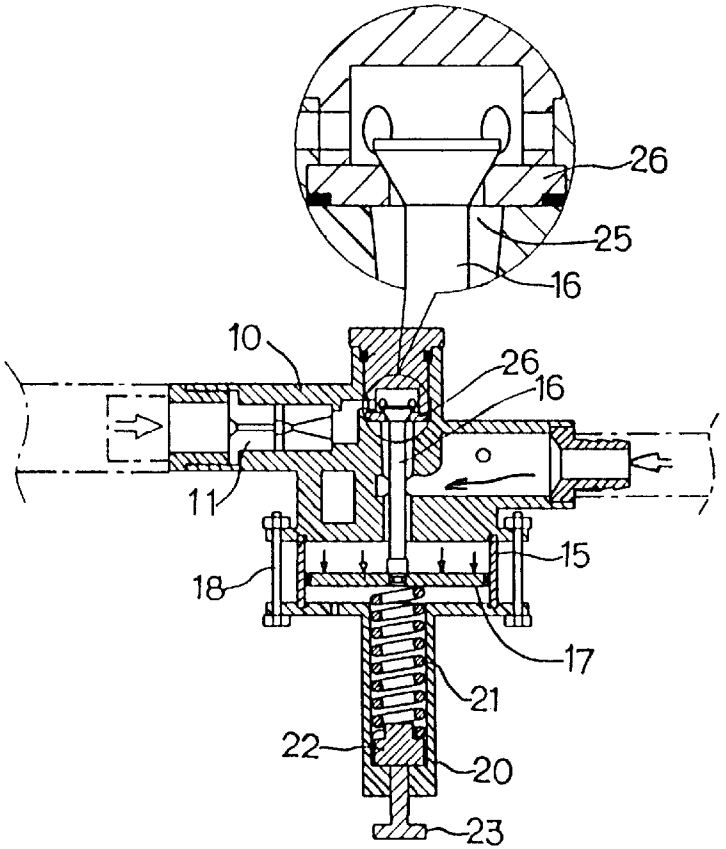
FIG. 4 is a schematic view showing the automatic closing of the water inlet pipe at recycle high pressure when the water outlet is closed.
Figure 5:
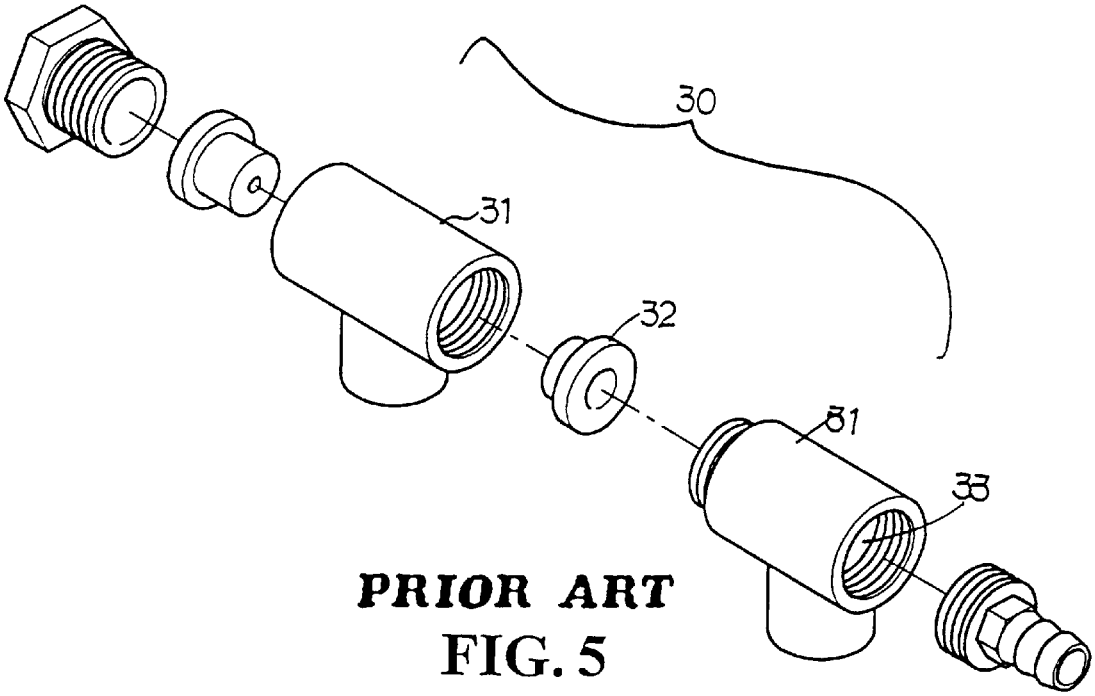
PRIOR ART FIG. 5
FIG. 5 is a perspective exploded view of a conventional body structure for mixing.
Figure 6:
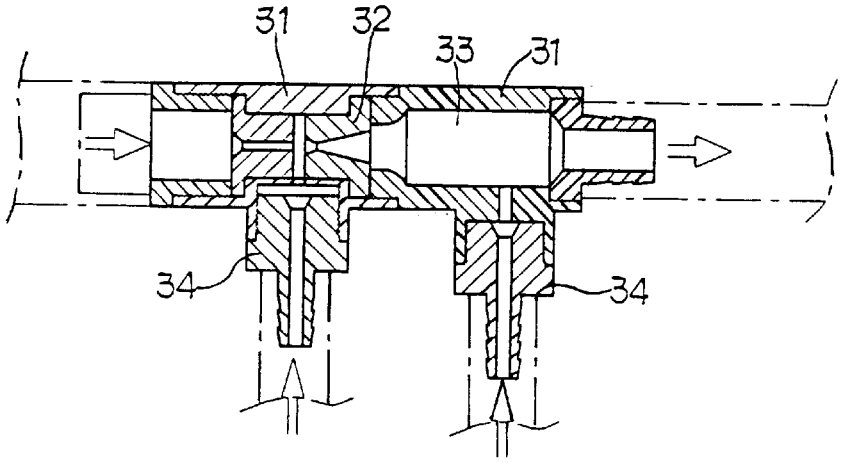
PRIOR ART FIG. 6
FIG. 6 is a sectional view of the conventional body structure for mixing.

Referring to FIGS. 1 to 3, there is shown an improved control structure of a cleaning device having suds with cleaning efficacy. In accordance with the present invention, the control mixing body 10 for suds production by mixing high pressurized air and detergent is designed into two stages water passage. The interior of the water passage at one lateral side of the water inlet is provided with a Venturi tube seat 11 for a detergent connection pipe 14 connected by a pipe connector 12. High pressure water stream flows through the Venturi tube seat 11 to achieve operation at elevated pressure and elevated speed, such that the detergent can be easily sucked into the interior of the body 10. In accordance with the requirements for water entry control, the lateral side of the middle section of the body 10 is provided with a protruded circular seat 13 for the mounting of a pressure room structure formed from a circular pipe 15. The interior of the pressure room structure is provided with a press board 17 connected with a plug shaft 16. The press board 17 slides to the inner edge of the pressure room structure. The external edge of the press board 17 is covered by a hood body 20 which is secured to the body 10 by a bolt 18. The interior of the hood body 20 is provided with a pressure adjusting spring 21 or an elastic element and a protruded block 22. A pressure adjusting bolt 23 mounted via the central, top edge of the hood body 20 can push the protruded block 22 so as to adjust the elastic tension of the spring 21 or the elastic body, for the balance of the press board 17. In accordance with the requirements, for the closing of the plug shaft 16, the water stream from the water outlet pipe 24 of a pump is directed to pass through the Venturi pipe seat 11 so as to increase the pressure and speed to absorb appropriate amount of detergent into the body 10, and then pass through the bending opening 25 of the plug shaft 16, and flow out from the other side of water outlet.

The mixing tank within the body 10 contains detergent. The mixing of detergent is assisted by the introduction of high pressurized air to form suds. The connection of the water outlet pipe 24 allows the suds to flow out to the article for cleaning.

In accordance with the present invention, in order to seal the edge between the plug shaft 16 and the bending opening 25, an inverted conic shaped plug ring 26 is mounted onto the bending opening 25. The plug shaft 16 slides to seal the edge and the conic face and the plug ring 26 can exactly be sealed so as to control the opening of the water passage.

In accordance with the present invention, in cleaning operation, the inlet water passes through the middle section of the body 10, and the spring 21 mounted thereto is pushed. The press board 17 is appropriately pushed to the circular pipe 15. When one side of water outlet is closed or the water outlet pipe 24 is squeezed to form a bend and the flow of water is interrupted, the entire water out flow will recycle to the interior of the body 10. Thus, the internal pressure of the body is increased. At this instance, the recycle and the continuous water stream will be directed to the front section of the press board 17 of the pressure room.

This will cause a pushing force on the press board 17. If the force is greater than the pressure of the spring 21, the board will slidably move to compress. Thus, the plug shaft 16 mounted with the press board 17 will move in a similar direction. Then, the plug shaft 16 will seal the opening edge of the bending opening 25. Thus, the water entry process is interrupted simultaneously, which ensures a balance of pressure at the interior of the body 10. In order to safe guard the operation of the entire pipes, the connector 12 section for the detergent and the high pressurized air input is provided with an anti-reverse flow valve to prevent reverse flow. When the pressure at the interior of the body 10 increases, the plug shaft 16 and other elements simultaneously seal the outlet pipe end for the detergent and the high pressurized air. Thus, the entire structure is safe in operation.

In accordance with the present invention, the safety control and adjustment of the pressure are based on the preset safety coefficient of the internal pressure. By variation of the pressure adjusting bolt 23, the variation of the protruded block 22 and the spring 21 will adjust the pressure control.

In accordance with the present invention, the middle section of the water inlet/outlet passage is provided with a bending opening to combine with a plug shaft connected to an adjusting device, such that the pressure increase within the interior of the body can be rapidly adjusted by the sliding of the press board. The sliding of the plug shaft seals the opening edge so that the internal pressure is balanced and is stably controlled.

While the invention has been described with respect to a preferred embodiment, it will be clear to those skilled in the art that modifications and improvements may be made to the invention without departing from the spirit and scope of the invention. Therefore, the invention is not to be limited by the specific illustrative embodiment, but only by the scope of the appended claims.

I claim:

1. a high pressure cleaning device having suds cleaning efficacy comprising a control body, containing a Venturi tube seat at the interior thereof, connected to an output of a pump, one side of the body being an inlet for the feeding of detergent and the other side being connected to a high pressurized air output pipe such that the water stream and the detergent are mixed and formed into suds flowing out from an outlet of the body to the outside for cleaning purpose, characterized in that a bending opening is provided to a middle section of the body connected to an inlet and outlet water passage, and an opening edge of the bending opening, corresponding to a lateral side of the body, a pressure-adjusting device is provided and a plug shaft is inserted at the bending opening and in combination with a conic shape end of the plug shaft and a press board mounted at the bottom end of the plug shaft to resist the pressure change of the pressure within the interior of the body, such that the press board is slidably moved within an air chamber of the body, the board moved to one lateral side will simultaneously pull the plug shaft to close the opening edge of the bending opening, thereby the water inlet or outlet is automatically closed at an appropriate time so as to ensure the stability of pressure within the body.

2. A high pressure cleaning device having suds cleaning efficacy as set forth in claim 1, wherein connectors for the connection pipes for detergent and high pressurized air is provided with an anti-reverse flow valve to prevent reverse flow of recycle fluid to the connection pipes when the water flow stops.

3. A high pressure cleaning device having suds cleaning efficacy as set forth in claim 1, wherein an external edge of the pressure adjusting device is provided with an adjustable bolt for the variably adjusting of pressure.

4. A high pressure cleaning device having suds cleaning efficacy as set forth in claim 1, wherein the edge of the bending opening is mounted with a plug ring to closely adhere to the conic shaped end of the plug shaft to seal the water stream.

* * * * *